US006864412B2

(12) United States Patent
Ichikawa

(10) Patent No.: US 6,864,412 B2
(45) Date of Patent: Mar. 8, 2005

(54) STEPLESS MUSIC RACK AND MUSICAL INSTRUMENT EQUIPPED WITH THE SAME

(75) Inventor: Tomonori Ichikawa, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/044,757

(22) Filed: Jan. 10, 2002

(65) Prior Publication Data

US 2002/0092400 A1 Jul. 18, 2002

(30) Foreign Application Priority Data

Jan. 15, 2001 (JP) ..... 2001-006188

(51) Int. Cl.[7] ..... G10C 3/02
(52) U.S. Cl. ..... 84/180
(58) Field of Search ..... 84/180–186.1, 84/177–179, 486, 487, 489, 490, 491, 500, 501

(56) References Cited

U.S. PATENT DOCUMENTS 3,887,275 A * 6/1975 Heist ..... 353/74
4,463,651 A * 8/1984 Hammer ..... 84/504
4,667,558 A * 5/1987 Murphy ..... 84/180
5,493,943 A * 2/1996 Horikawa ..... 84/519
5,575,097 A * 11/1996 Chou et al. ..... 40/531
5,942,702 A 8/1999 Inoue
6,107,558 A * 8/2000 Cowan ..... 84/488
6,469,237 B1 * 10/2002 Arimori ..... 84/174

FOREIGN PATENT DOCUMENTS

JP 2001-12493 1/2001

OTHER PUBLICATIONS

Catalog of One–Way Clutch, Tok Bearing Co., Ltd., Tokyo, Japan, Jan. 31, 1997, pp. 20–22 (catalog includes English translation).
Catalog of Over Running Clutch, Daido Precision Industries, Ltd., Copyright 2001.

* cited by examiner

*Primary Examiner*—Kimberly Lockett
(74) *Attorney, Agent, or Firm*—Morrison & Foerster LLP

(57) ABSTRACT

An acoustic piano is equipped with a desk board fallen down onto and raised on a desk rail, wherein a one-way clutch and releaser are provided between the desk rail and a shaft connected to the desk board so that a pianist raises the desk board and keeps it at the optimum angular position without any prop.

17 Claims, 8 Drawing Sheets

STEPLESS MUSIC RACK AND MUSICAL INSTRUMENT EQUIPPED WITH THE SAME

FIELD OF THE INVENTION

This invention relates to a musical instrument and, more particularly, to a built-in musical rack incorporated in a musical instrument for keeping a music score in front of a player and a musical instrument equipped with the music rack.

DESCRIPTION OF THE RELATED ART

While a player is performing a piece of music on a musical instrument, he or she usually keeps a music score on a music stand. Several kinds of musical instrument such as an acoustic piano, electric piano and organ are equipped with music racks. The music racks are usually foldable. When a player gets ready to play a piece of music on the keyboard musical instrument, he or she makes the built-in music rack stand, and puts a music score thereon.

FIG. 1 shows a typical example of the built-in music rack incorporated in a grand piano. The prior art built-in music rack is fallen onto and rises on a board, which forms a part of the piano case. Namely, the prior art built-in music rack is foldable. The prior art built-in music rack comprises a desk board 2 and a prop 3. The desk board 2 is rotatably connected at the lower end thereof to the board 1 by means of a hinge 4, and the hinge 4 gives an axis of rotation to the desk board 2. For this reason, the desk board 2 is rotatable in directions indicated by arrows AR1. The prop 3 is rotatably connected at one end thereof to an intermediate area of the rear surface of the desk board 2 by means of a hinge 5. The hinge 3 also gives an axis of rotation to the prop 3, and is rotatable in directions indicated by arrows AR2.

A series of notches 6 are formed in the board 1 at regular pitches at the back of the hinge 4, and the prop 3 is engagable at the lower end thereof with any one of the notches 6. The desk board 2 is formed with a stopper 7, and another stopper 8 is fixed to the board 1 in front of the desk board 2. The stopper 7 is provided in the vicinity of the hinge 5, and rearwardly projects from the rear surface of the desk board 2. The stopper 7 is inclined to the hinge 5, and the angle between the stopper 7 and the rear surface is adjusted to a predetermined angle. Thus, the stopper 7 is provided on the trajectory of the prop 3.

The prop 3 is laminated on the rear surface of the desk board 2, and the desk board 2 is fallen down on the board 1 as indicated by dots-and-dash lines. When a pianist wishes to play a piece of music on the prior art grand piano, the pianist pinches the free end of the desk board 2 between his or her fingers, and raises the desk board 2. While the pianist is rotating the desk board 2, the prop keeps itself vertical to the board 1 due to the self-weight. When the desk board 2 passes an appropriate position, the pianist keeps the desk board 2 there, and rotates the prop 3 about the hinge 5 in the counter clockwise direction. The prop 3 is brought into contact with the stopper 7. Then, the pianist returns the desk board 2 to the appropriate position. The prop 3 is engaged with one of the notches 6, and holds the desk board 2 at the appropriate position. The pianist puts a music score 9 on the desk board 2. Although the music score slides on the board 1, the stopper 8 does not allow the music score to slide thereover, and the music score 9 is maintained between the desk board 2 and the stopper 8.

When the pianist finishes the piece of music, he or she may turn his or her attention to another thing. The pianist folds the prior art as follows. First, he or she slightly pulls the desk board 2, and disengages the prop 3 from the notch 6. Thereafter, he or she reaches around, and laminates the prop 3 on the rear surface of the desk board 2. Finally, he or she falls the desk board 2 down onto the board 1 together with the prop 3.

A problem is encountered in the prior art music rack in that the player can not put the music score at the optimum position. Players are different in height, and sit in different attitude on the stool in front of the grand piano. This means that the optimum position is dependent on the individual players. Although the desk board 2 is stepwise inclined on the board 1, the angle is merely varied at the regular pitches of the notches, and it is rare that the desk board 2 takes the optimum position.

Another problem is poor manipulability. The prop 3 is connected to the rear surface of the desk board 2, and the player stands in front of the desk board 2. When the player falls down or raises the desk board 2, he or she reaches around and manipulates the prop 3. Children feel the manipulation difficult, because their arms are too short to reach around. If a child manipulates the prop 3 in an unnatural attitude, the desk board 2 may slip off his or her fingers. The desk board 2 falls down on the board 1, and has his or her fingers pinched between the board 1 and the desk board 2.

While a pianist is playing a piece of music on the grand piano in concert hall, part of the audience sits on the seats on the opposite side to the pianist, and brings the gaze to bear upon the pianist. There is the prop 3 on their eyes. Most of the audience feels the prop 3 an eyesore.

SUMMARY OF THE INVENTION

It is therefore an important object of the present invention to provide a music rack, which keeps a music score at the optimum position to each user without complicate manipulation and any eyesore.

It is also an important object of the present invention to provide a musical instrument equipped with the music rack.

In accordance with one aspect of the present invention, there is provided a music rack used for keeping a document thereon comprising a desk board on which the document is put and changed from a rest position through a maximum attitude angle position to a release position, and an attitude changing system provided between a stationary member and the desk board, permitting the desk board to unidirectionally change the position from the rest position to the maximum attitude angle position and allowing the desk board to return to the rest position when the desk board reaches the release position.

In accordance with another aspect of the present invention, there is provided a musical instrument comprising a case having plural boards assembled for defining an inner space, a keyboard placed on one of the plural boards in such a manner that a player fingers thereon, a tone generating system accommodated in the inner space and connected to the keyboard for generating tones in response to the fingering, and a music rack provided on another of the plural boards and including a desk board on which the document is put and changed from a rest position through a maximum attitude angle position to a release position and an attitude changing system provided between a stationary member and the desk board, permitting the desk board to unidirectionally change the position from the rest position to the maximum attitude angle position and allowing the desk board to return to the rest position when the desk board reaches the release position.

BRIEF DESCRIPTION OF THE DRAWINGS

The features and advantages of the music rack and the musical instrument will be more clearly understood from the following description taken in conjunction with the accompanying drawings in which.

DESCRIPTION OF THE PREFERRED EMBODIMENTS

First Embodiment

Figure 1:
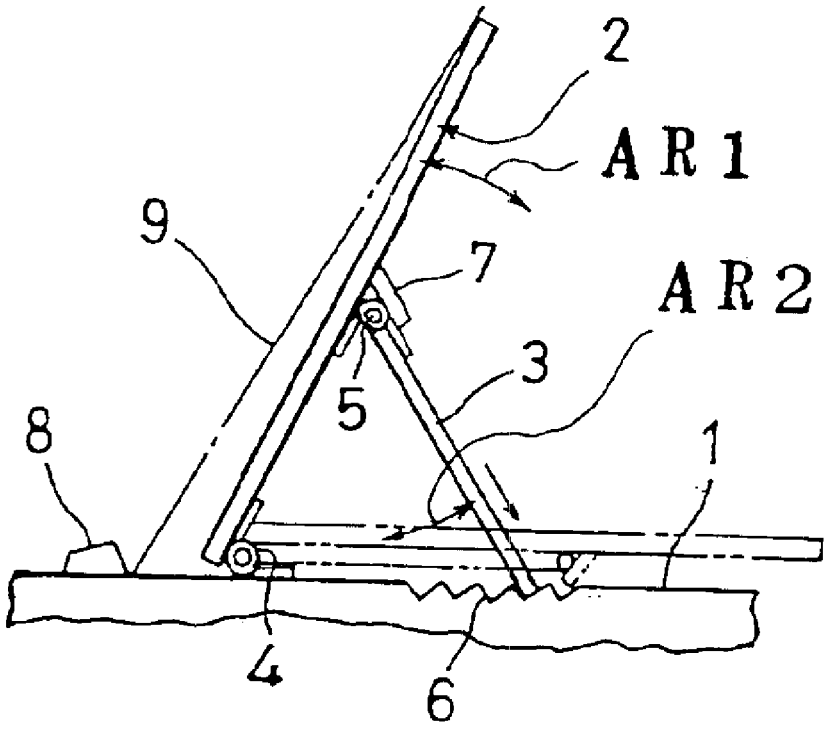
Fig. 1 PRIOR ART
FIG. 1 is a side view showing the structure of the prior art music rack of the grand piano.
Figure 2:
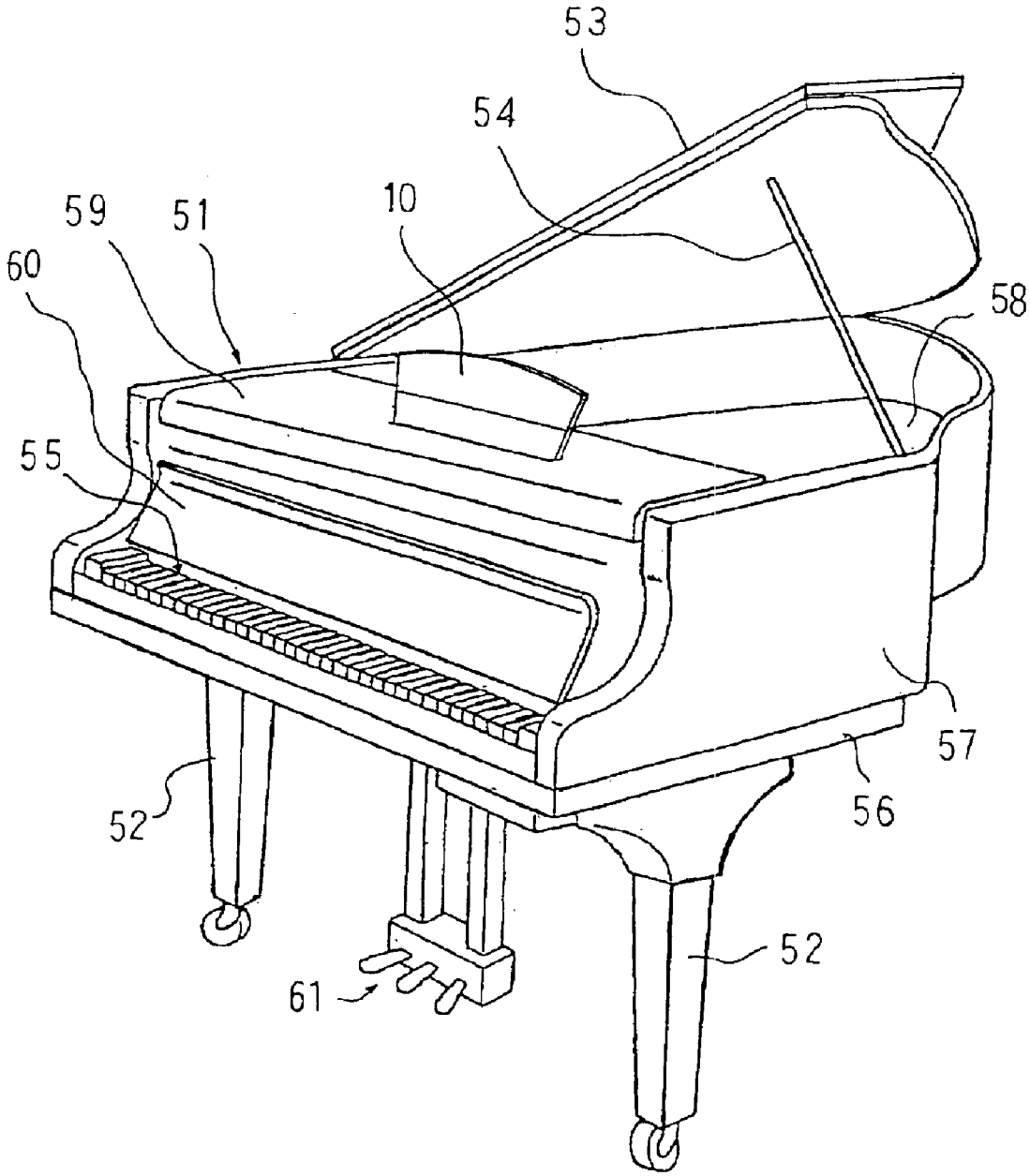
FIG. 2 is a perspective view showing the appearance of a grand piano according to the present invention.

Referring first to FIG. 2 of the drawings, a grand piano embodying the present invention comprises a piano case 51, legs 52, a top board 53, a lid prop or top stick 54, a keyboard 55, a pedal mechanism 61 and a stepless music rack 10. Although an action mechanism, hammers and strings are further incorporated in the grand piano, they are not shown in FIG. 2 for the sake of simplicity.

The piano case 51 is fabricated from various board members such as a key bed 56, a side board 57, a sound board 58 and a desk rail 59, and defines an inner space. The action mechanism and the hammers are housed in the piano case, and the strings are stretched over the sound board 58. The top board 53 is hinged to the side board 57, and is opened and closed by its user. The lid prop 54 is pivotally connected at the lower end thereof to the side board 57, and the top board 53 leans against the lid prop 54. Thus, the lid prop 54 keeps the top board 53 open. The legs 52 downwardly project from the piano case 51, and keep the piano case 51 over a flat surface. The keyboard 55 is mounted on the front portion of the key bed 56, and is to be covered with a fall board 60. The stepless music rack 10 is provided on the desk rail 59, and keeps a music score (not shown) in front of a pianist sitting on a stool.

While the pianist is fingering a piece of music on the keyboard 55, the action mechanism selectively drives the hammers for rotation, and the hammers strike the associated strings for generating piano tones. The behavior of the action mechanism/hammers is well known to persons in the art, and, for this reason, no further description is hereinbelow incorporated.

Figure 3:
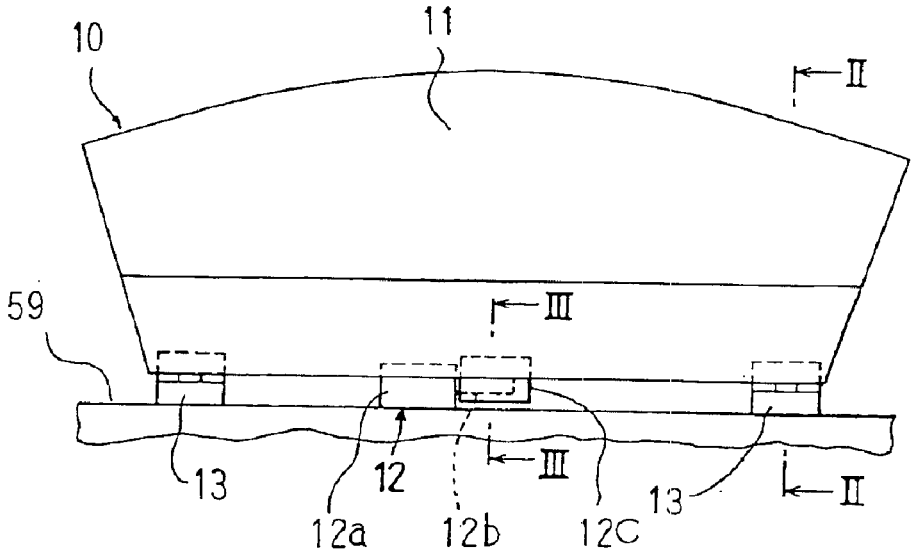
FIG. 3 is a front view showing the appearance of a stepless music rack incorporated in the grand piano.
Figure 4:
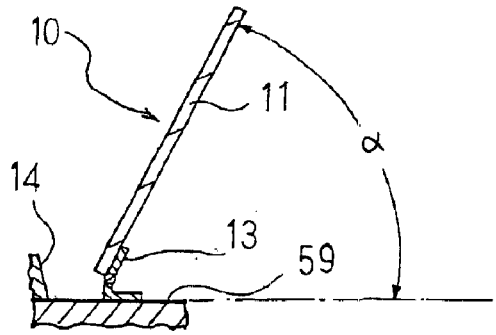
FIG. 4 is a cross sectional view taken along line II—II of FIG. 3 and showing the structure of the stepless music rack.
Figure 5:
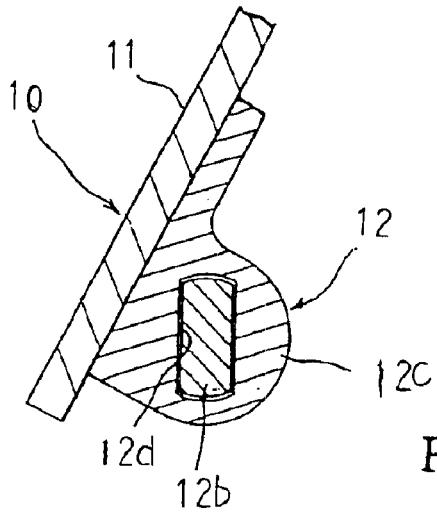
FIG. 5 is a cross sectional view taken along line III—III of FIG. 3 and showing the structure of an attitude changer incorporated in the stepless music rack.

Turning to FIGS. 3, 4 and 5 of the drawings, the stepless music rack 10 largely comprises a desk board 11, an attitude changer 12, hinges 13 and a stopper 14. The desk board 11 is, by way of example, formed of wood, and has a generally sectoral configuration. The hinges 13 are provided on both sides of the attitude changer 12, and rotatably supports the desk board 11 over the desk rail 59. The friction of the hinges 13 is negligible, and the hinges 13 can not keep the desk board 11 at a given attitude angle without assistance of the attitude changer 12. However, the low-friction is not any essential feature. Another stepless music rack may have large-friction hinges. The number of hinges 13 is dependent on the size of the desk board 11. A wide desk board may have more than two hinges 13, i.e., three hinges or four hinges. The attitude changer 12 achieves a stepless regulation for the user. The desk board is fallen down on the opposite side of the pianist sitting in front of the keyboard 55, and rises on the desk rail 59 as shown in FIG. 4. The angle $\alpha$ between the desk board 11 and the desk rail 59 is varied from zero degree to 80 degrees.

The attitude changer 12 is broken down into a mechanic box 12*a*, a shaft 12*b* and a coupler 12*c*. Though not shown in FIGS. 3 to 5, one-way clutch and a releaser are housed in the mechanic box 12*a*, and the mechanic box 12*a* is secured to the desk rail 59. The shaft 12*b* is connected to the on-way clutch and the releaser, and laterally projects from the side surface of the mechanic box 12*a*. The coupler 12*c* is fixed to the rear surface of the desk board 11, and the free end portion of the shaft 12*b* is secured to the desk board 11 by means of the coupler 12*c*. In detail, the shaft 12*b* has a generally rectangular cross section, and a recess 12*d* is formed in the coupler 12*c* as shown in FIG. 5. The free end portion of the shaft 12*b* is inserted into the recess 12*d*. The coupler 12*c* curbs the free rotation of the shaft 12*b* in the recess 12*d*. For this reason, the desk board 11 is rotated together with the shaft 12*b*.

The one-way clutch permits the user to change the desk board 11 from zero to 80 degrees, and keeps the desk board 11 at any angle at which the user stops the rotation. The releaser is enabled when the desk board 11 reaches a certain angle range $\beta$ between 100 and 110 degrees (see FIG. 6). When the desk board 11 reaches the angle range $\beta$, the mechanic box 12*a* notifies the pianist that the shaft 12*b* is released from the one-way clutch through click. A suitable stopper is provided in the mechanic box 12*a* so that the desk board 11 can not be rotated over the certain angle range $\beta$. The releasing mechanism releases the shaft 12*b* from the one-way clutch, and allows the desk board 11 to return to the rest position at zero degree. While the desk board 11 is returning to the rest position A (see FIG. 6), the mechanic box gives suitable resistance against the rotation of the shaft 12*b*. For this reason, even if the pianist releases the desk board 11 from his or her hand, the mechanic box 12*a* keeps the desk board 11 there, and the desk board 11 is never fallen down violently.

Figure 6:
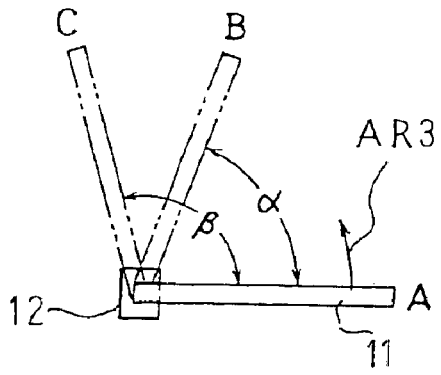
FIG. 6 is a side view showing change of an attitude angle with assistance of the attitude angle.

When a pianist wishes to make the desk board 11 closer to the vertical attitude, he or she pulls the desk board 11 toward him or her. Then, the one-way clutch permits the shaft 12*b* to be rotated together with the desk board 11. When the pianist stops the rotation, the one-way clutch keeps the shaft 12*b* and, accordingly, the desk board 11 at the given attitude. On the other hand when the pianist feels the desk board 11 too close to the vertical attitude, he or she rotates the desk board 11 beyond the maximum attitude angle, i.e., 80 degrees. When the desk board 11 reaches the angle range $\beta$ between 100 degrees and 110 degrees, the shaft 12*b* is released from the one-way clutch. The pianist firstly falls down the desk board 11 on the desk rail 59. The desk board 11 changes the attitude C to the attitude A as shown in FIG. 6. The one-way clutch is enabled at zero degree, again. Although the one-way clutch permits the desk board 11 to return to the rest position A at zero degree, the one-way clutch gives appropriate resistance to the rotation toward the rest position so as to prevent the desk board 11 from a violent fall. The pianist pulls the desk board 11 toward him or her as indicated by arrow AR3. The one-way clutch permits the desk board 11 and, accordingly, the shaft 12*b* to be rotated. When the desk board 11 reaches the optimum position at attitude angle α, the pianist stops the rotation, the one-way clutch keeps the desk board 11 at the optimum angle. Thus, the pianist adjusts the desk board 11 at the optimum position by virtue of the attitude changer 12.

The one-way clutch and the releasing mechanism are commercially obtainable from the market. A mechanical one-way clutch with built-in releasing mechanism commercially obtainable from the market is disclosed in Japanese Patent Application laid-open No. 2001-12493, and is implemented by a roller, a cum and a coil spring. The Japanese Patent Application laid-open teaches an application of the mechanical one-way clutch with built-in releasing mechanism to a door or lid. However, the Japanese Patent Application laid-open is silent to any application to a keyboard musical instrument and, especially, to a music rack.

A hydraulic one-way clutch controls the flow of fluid. The fluid is sealed in a cylinder, and a rotor, check valve and throttle value are provided inside the cylinder. The check valve permits the fluid to flow one-directionally, but the throttle valve generates strong resistance against the fluid flowing vice versa. While a pianist is rotating the desk board 10 in the direction to increase the attitude angle α, the fluid flows through the check valve from one chamber to another. However, even through the desk board 11 is forced in the opposite direction, the check valve prohibits the fluid from flowing there-through, and only the throttle valve provides the passage to the fluid flowing vice versa. The throttle valve is designed not to flow the fluid under the condition that moment due to the self-weight of the desk board is exerted on the rotor. However, when the user pushes the desk board, large moment is exerted on the rotor, and the rotor forces the fluid to flow through the throttle valve.

As will be understood from the foregoing description, the music rack according to the present invention includes the attitude changer 12. The mechanic box 12*a* permits the pianist to rotate the desk board 11 from the rest position A toward the maximum attitude angle α, and keeps the desk board 11 at the given angle α without any prop. Thus, the attitude changer permits pianists to change the attitude of the desk board 11 in the stepless fashion. Any prop is not required for the stepless music rack. In other words, there is not any eyesore on the eyes of the audience. Thus, the grand piano is improved in external appearance.

Moreover, the pianist simply pulls and pushes the desk board 11 in order to change the attitude angle. It is not necessary to reach around and hold a prop at the back of the desk board 11. Thus, the attitude changer according to the present invention makes the attitude change easy.

Finally, the mechanic box 12*a* gives appropriate resistance against the rotation of the desk board 11, and presents the desk board 11 from a violent fall. This results in making the attitude change easy.

Second Embodiment

Figure 7:
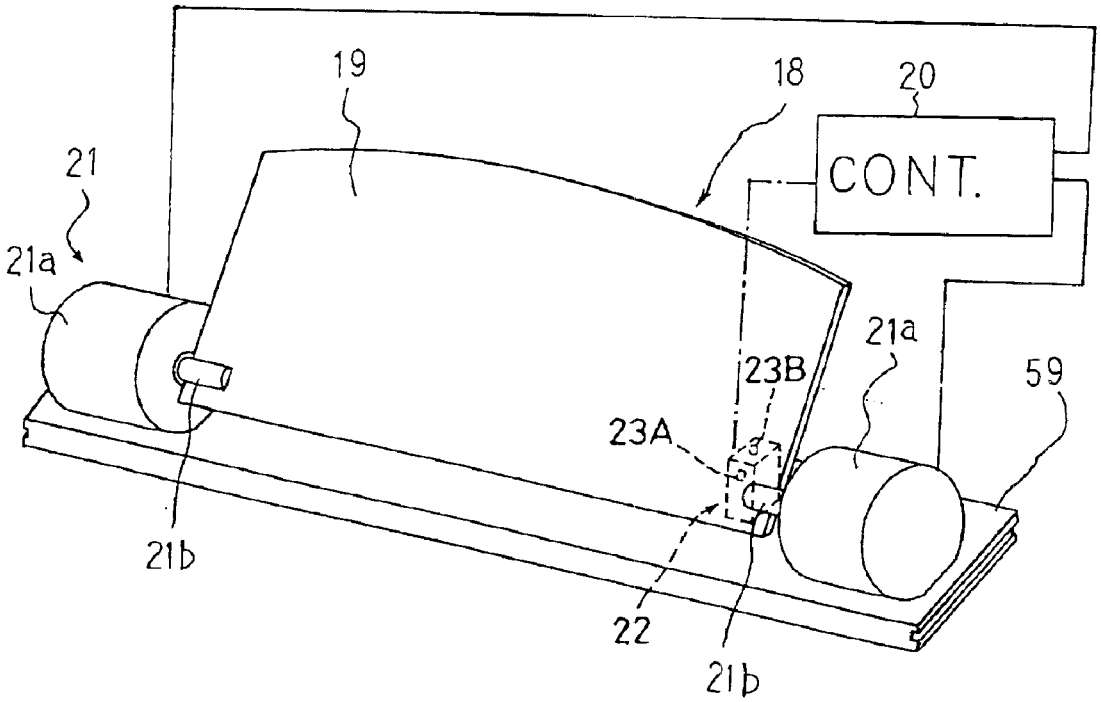
FIG. 7 is a perspective view showing another stepless music rack according to the present invention.

Turning to FIG. 7 of the drawings, another stepless music rack 18 embodying the present invention is mounted on a board such as, for example, a desk rail 59. The stepless music rack 18 comprises a desk board 19, a controller 20, an attitude changer 21, a limit switch 22 and a stopper (not shown). The desk board 19 is similar to the desk board 11, and the stopper prevents a music score from slippage on the desk rail 59 as similar to the stopper 14. The attitude changer 21 includes a pair of mechanic boxes 21*a* and a pair of shafts 21*b*. The mechanic boxes 21*a* are secured to the desk rack 59, and the shafts 21*b* laterally project from the mechanic boxes 21*a*, respectively. The shafts 21*b* are connected to both side portions of the desk board 19, and keep the desk board 19 over the desk rail 59. Thus, any hinge is not required for the stepless music rack 18.

The mechanic boxes 21*a* are similar in structure to each other, and each of the mechanic boxes 21*a* has a one-way clutch and an electromagnetic releaser. The one-way clutch is connected to the associated shaft, and the electromagnetic releaser is responsive to a driving signal so as to enable and disable the on-way clutch. The driving signal is supplied from the controller 20, and the controller 20 changes the driving signal between active and inactive depending upon detecting signals supplied from the limit switch 22. The one-way clutches are of the mechanical type or the hydraulic type as similar to those of the first embodiment. When the desk board 19 reaches the angle range β, the mechanic boxes 21*a* notify the pianist to reach the angle range by generating click.

Figure 8:
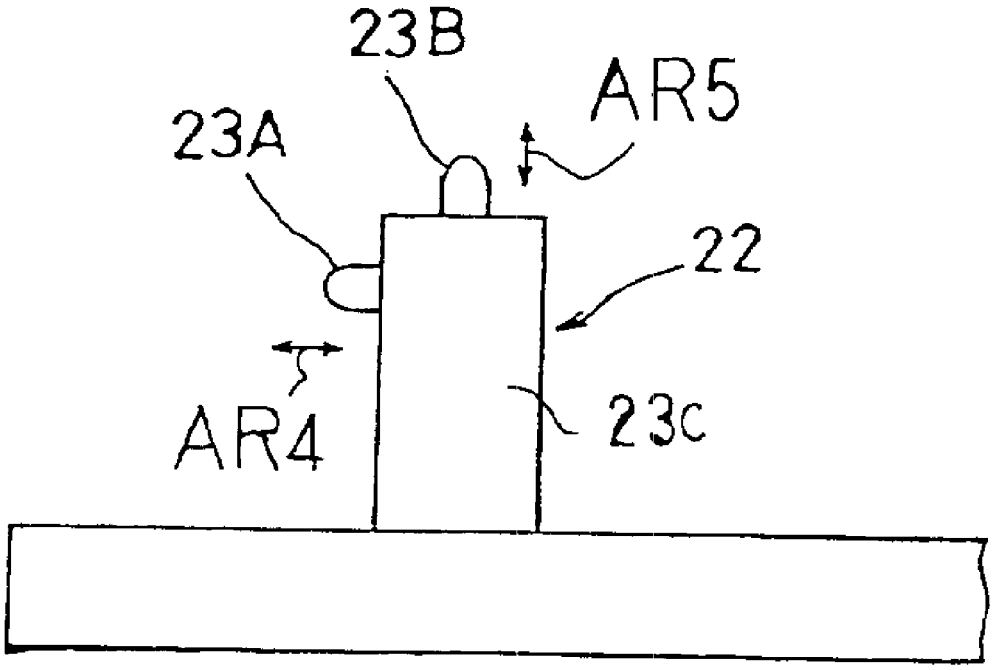
FIG. 8 is a side view showing a limit switch used in the stepless music rack

The limit switch 22 is provided at the back of the desk board 19, and has two detectors 23A and 23B as shown in FIG. 8. The detector 23A is projectable from and retractable into a body 23*c* in directions indicated by arrows AR4. On the other hand, the detector 23B is projectable from and retractable into the body 23*c* in directions indicted by arrows AR5. The detectors 23A/23B remain projected without any external force exerted thereon desk board 19 reaches the angle range beyond the vertical position, the desk board 19 pushes the detector 23A into the body 23*c*, and the limit switch 22 supplies the detecting signal representative of arrival at the release position, i.e., attitude angle β greater than 90 degrees to the controller. Then, the controller 20 supplies the driving signal of the inactive level to the electromagnetic releasers, and the electromagnetic releasers release the shafts 21*b* from the one-way clutches. On the other hand, when the desk board 19 reaches the rest position, i.e., zero degree, the desk board 19 pushes the detector 23B into the body 23*c*, and the limit switch 22 supplies the detecting signal representative of the rest position to the controller 20. Then, the controller 20 supplies the driving signal of the active level to the electromagnetic releasers, and the electromagnetic releasers enable the one-way clutches.

Figure 9:
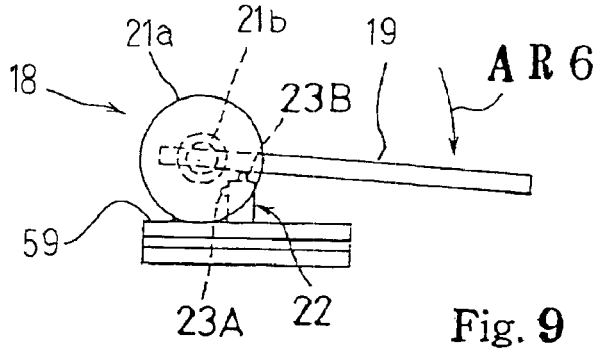
FIGS. 9, 10 and 11 are side views showing the stepless music rack at different attitude angles.

The stepless music rack 18 behaves as follows. Assuming now that the desk board 19 is maintained at the rest position as shown in FIG. 9. The desk board 19 pushes the detector 23B of the limit switch 22 into the body 22*a*, and the limit switch 22 is supplying the detecting signal representative of the rest position to the controller 20. The controller 20 maintains the driving signal at the active level, and enables the electromagnetic releaser with the control signal.

Figure 10:
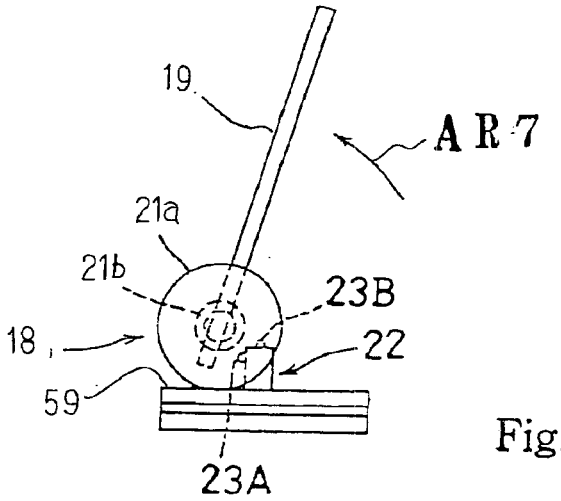

The pianist wishes to change the attitude of the desk board 19. The pianist pulls the desk board 19 toward him or her. The on-way clutches permits the desk board 19 to be rotated as indicated by arrow AR7 in FIG. 10. When the desk board 19 reaches the optimum position, the pianist stops the rotation. The one-way clutches do not permits the desk board 19 to fall down, and keeps the desk board 19 at the optimum position.

Figure 11:
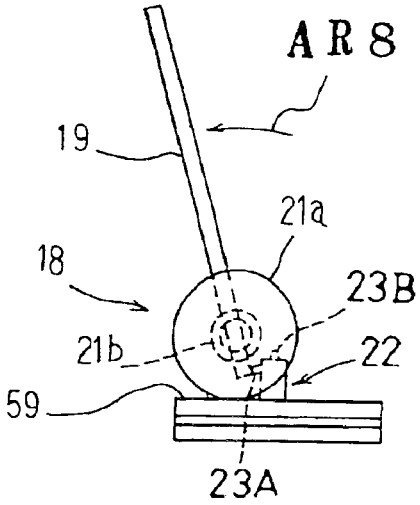

The player is changed to another pianist. The pianist is assumed to think it better to make the desk board inclined. The pianist pulls the desk board 19 toward him or her over the maximum attitude angle α as indicated by arrow AR8 in FIG. 11. When the desk board 19 reaches the angle range β, the mechanic boxes 21*a* generate the click so as to notify the pianist to enter the angle range β, and the desk board 19 pushes the detector 23A into the body 22*a*. The limit switch 22 supplies the detecting signal to the controller 20, and the controller changes the driving signal to the inactive level. Then, the electromagnetic releasers disable the associated one-way clutches, and the shafts 21*b* are released from the one-way clutches. The pianist pushes the desk board 19, and rotates the desk board 19 as indicated by arrow AR6. Even if the pianist releases the fingers from the desk board 19, the mechanic boxes 21*a* give appropriate resistance against the rotation in the direction indicated by arrow AR6, and present the desk board 19 from a violent fall. When the desk board 19 reaches the rest position, the detector 23B is pressed, and the limit switch 22 generates the detecting signal to the controller 20. The controller acknowledges that the desk board 19 reaches the rest position, and changes the driving signal to the active level. The driving signal is supplied to the electromagnetic releasers, and the electromagnetic releasers enable the associated one-way clutches. The one-way clutches only permit the pianist to rotate the desk board 19 in the direction opposite to the arrow AR6. The pianist pulls the desk board 19 toward him or her, and rotates the desk board 19 in the direction indicated by arrow AR7. When the desk board 19 reaches the optimum angle, the pianist stops the rotation, and the one-way clutches keep the desk board 19 at the optimum position.

As will be appreciated from the foregoing description, the attitude changer according to the present invention keeps the desk board at any angle on the way from the rest position to the maximum attitude angle α. Thus, a pianist can adjust the desk board to the personally optimum attitude with the assistance of the attitude changer.

The pianist simply pulls and pushes the desk board so that the attitude change is easy for the pianist.

Any prop is never required for keeping the desk board at an attitude angle. This results in improvement of external appearance of the keyboard musical instrument.

In the first embodiment, the attitude changer 12 and the hinges 13 as a whole constitute an attitude changing system. In the second embodiment, the attitude changer 21, the controller 20 and the limit switch 22 form in combination the attitude changing system.

Figure 12:
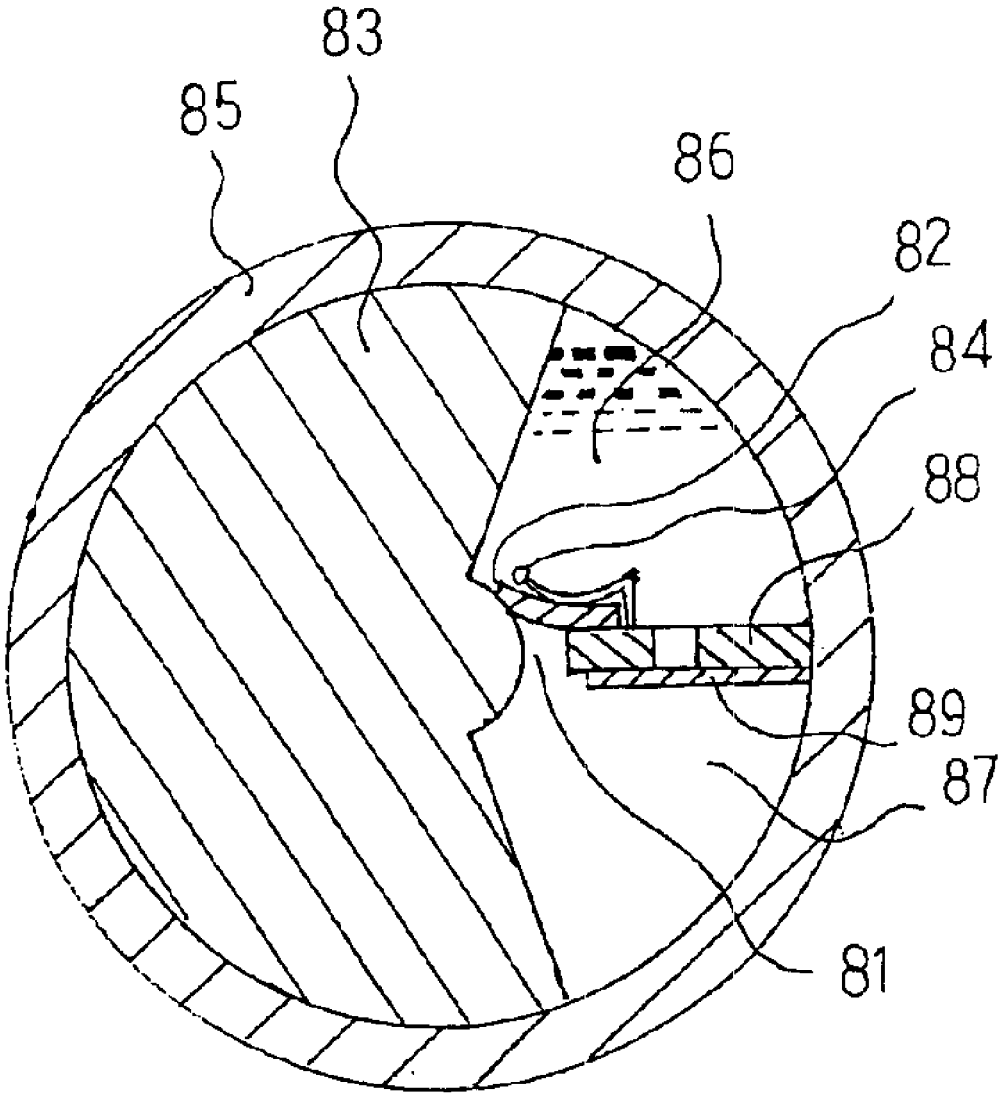
FIG. 12 is a cross sectional view showing the structure of a hydraulic one-way clutch.

The hydraulic one-way clutch may be a modification of the rotary damper disclosed in U.S. Pat. No. 5,942,702. The U.S. Patent was assigned to Yamaha Corporation. This invention will be assigned to Yamaha Corporation. In order to reduce the resistance against the rotation in the direction to decrease the attitude angle α without fall-down, the throttle 81 is widened, and another check valve 82 is urged toward the rotor 83 by means of a spring 84 as shown in FIG. 12. The rotor 83 is rotatably accommodated in the cylinder 85, and defines two chambers 86 and 87 inside the cylinder 85 together with the partition wall 88. The chambers 86 and 87 are filled with fluid. The throttle 81 is wide enough to flow the fluid between the chambers 86 and 87 without large resistance. The check valve 82 close throttle 81, and the spring 84 presses the check valve 82 against the rotor 83 as shown.

When the desk board is raised, the rotor 83 is rotated in the clockwise direction, and the fluid flows from the chamber 86 to the chamber 87. The check valve 89 opens the hole formed in the partition wall 88, and permits the fluid to pass therethrough without large resistance. The pianist stops the rotation. Then, the check valve 89 closes the hole, and the check valves 82/89 prohibit the fluid from flowing between the chambers 86 and 87. Even though a small moment is exerted on the rotor due to the component force of the self-weight of the desk board, the spring 84 keeps the throttle 81 closed. However, if the pianist exerts a force on the desk board, the rotor 83 applies large pressure against the check valve 82, and the check valve 82 is spaced from the rotor 83 against the elastic force of the spring 84. As a result, the fluid flows from the chamber 87 to the chamber 86, and the desk board changes the attitude.

Figure 13:
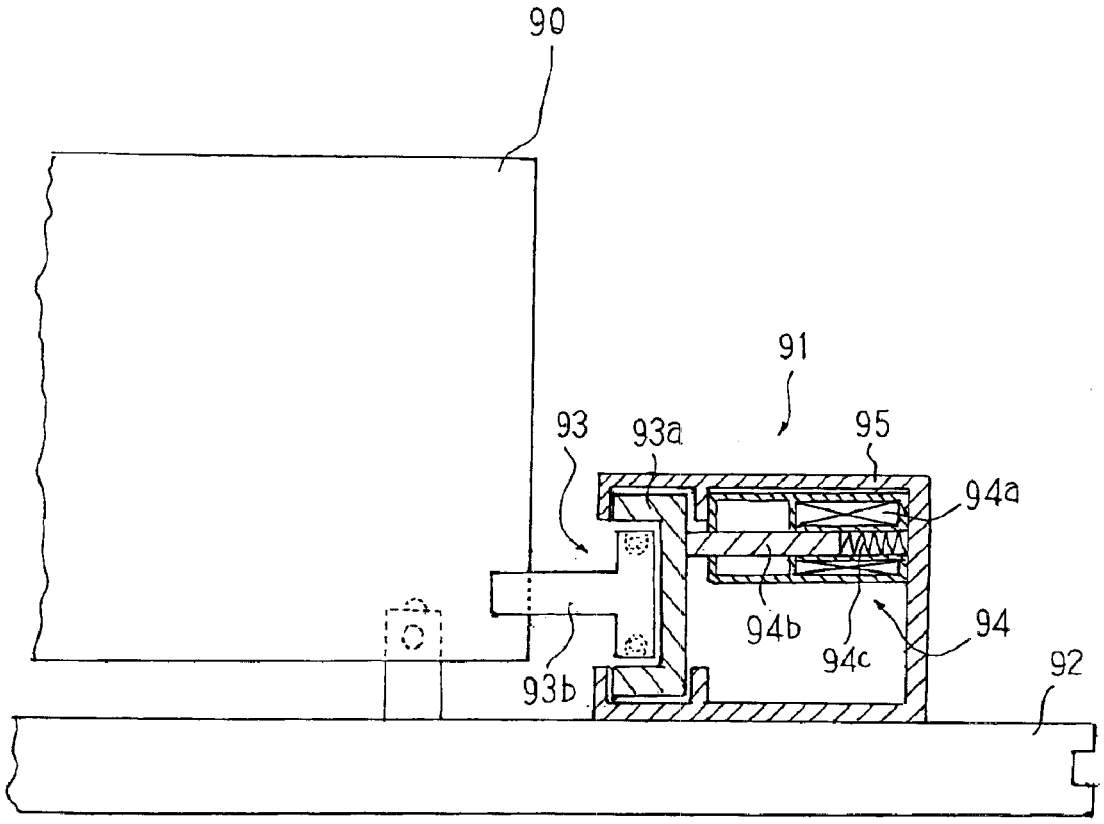
FIG. 13 is a cross sectional view showing a modification of a releaser incorporated in the stepless music rack according to the present invention.

A modification of the releaser is shown in FIG. 13. The stepless music rack is broken down into a desk board 90 and an attitude changing system 91. The desk board 90 is turnably supported over a board 92, and the attitude changing system 91 is secured to the board 92 on the right side of the desk board 90. The attitude changing system 91 includes a one-way clutch 93 and a releaser 94. The one-way clutch is of the mechanical type or the hydraulic type. A one-way clutch manufactured by TOK Bearing co., ltd. or a free wheel manufactured by Daido Precision Industries co. ltd. is available for the attitude changing system 91. The releaser 94 is combined with the releaser 94, and is housed in a casing 95 together with the releaser 94. The one-way clutch 93 is constituted by a housing 93*a* and a rotor 93*b*. The housing 93*a* is rotatable in the casing 95, and the rotor 93*b* is unidirectionally rotatable in the housing 93*a*. The rotor 93*b* is connected at the left end thereof to the desk board 90. When a user raises the desk board 90, the rotor 93*b* is rotated with respect to the housing 93*a*. However, the one-way clutch mechanism does not permit the user to rotate the rotor 93*b* in the opposite direction. The releaser 94 is fixed to the casing 95, and includes a solenoid 94*a* provided inside a yoke, a plunger 94*b* movable into and out of the yoke and a spring 94*c* inserted between the yoke and the plunger 94*b*. While any current flows through the solenoid 94*a*, the plunger 94*b* is pressed against the housing 93*a* due to the elastic force of the spring 94*c*. For this reason, the housing 93*a* is pressed against the casing 95. Thus, the housing 93*a* is not rotatable in the casing 95 in so far as the solenoid 94*a* does not generate any electromagnetic force. When the user wants to fall down the desk board 90, the user energizes the solenoid 94*a*, and the solenoid 94*a* creates magnetic field. The plunger 94*b* is retracted into the yoke against the elastic force of the spring 94*c*, and the force is removed from the housing 93*a*. This means that the housing 93*a* becomes rotatable in the casing 95. The user pushes the desk board 90, and falls down the desk board 90 onto the board 92. Thus, the releaser 94 permits the user to fall down the desk board 90.

Although particular embodiments of the present invention have been shown and described, it will be apparent to those skilled in the art that various changes and modifications may be made without departing from the spirit and scope of the present invention.

For example, the desk board 11 may have an L-letter cross section. In this instance, a music score is maintained on the desk board 11 without any stopper. Thus, the stopper 14 is not an indispensable element. The desk board 11 may be formed of synthetic resin, metal or alloy. A rectangular desk board may form a part of the stepless music rack according to the present invention.

The stepless music rack may be provided in another kind of keyboard musical instrument such as, for example, an upright piano, an electric piano, an electronic keyboard, an organ, a harpsichord and a composite keyboard musical instrument. The composite keyboard musical instrument is a combination between an acoustic keyboard musical instrument and an electronic system. A silent piano, automatic player piano and keyboard for practical use are examples of the composite keyboard musical instrument. The silent piano and automatic player piano are briefly described hereinbelow.

The silent piano is a combination of an acoustic piano, i.e., a grand piano or upright piano and an electronic tone generating system, and a pianist can play a piece of music in acoustic tones or electronic tones. In order to permit the pianist to play a piece of music in the electronic tones, the silent piano is equipped with a hammer stopper and an electronic sound generating system. The hammer stopper is provided in association with the hammers, and is changed between a free position and a blocking position. While the hammer stopper is maintained at the free position, the hammers strike the associated sets of strings without any interruption by the hammer stopper. When the hammer stopper is changed to the blocking position, the hammer stopper enters into the trajectories of the hammers, and the hammers rebound on the hammer stopper before striking the strings. The electronic sound generating system produces electronic sounds instead of the piano tones so that user can practice the fingering without disturbance to the neighborhood.

The automatic player piano is a combination of an acoustic piano and an automatic playing system. The acoustic piano is either grand or upright. The automatic playing system includes solenoid-operated key actuators installed under the keyboard and a controller. When a set of music data codes is supplied to the controller, the controller analyzes the set of music data codes, and selects the keys to be moved from the keyboard and times at which the keys start the motion. When the time comes, the controller supplies a driving signal to the solenoid-operated key actuator under the key to be moved. The solenoid-operated key actuator moves the key at the give time, and the key actuates the action unit so as to give rise to free rotation of the hammer toward the string.

The keyboard for practical use is a modification of the acoustic piano. The hammer assemblies and strings are replaced with beaters and an impact absorber. While a trainee is fingering a piece of music on the keyboard, the depressed keys actuate the associated action units, which in turn give rise to free rotation of the hammers through the escape. The beaters rebound on the impact absorber, and the piano tones are not generated. An electronic tone generating system may be further incorporated in the keyboard for practical use. In this instance, sensors monitor the beaters, and periodically report the current positions of the beaters. The controller analyzes the series of positional data information so as to specify the depressed keys. The controller produces music data codes representative of the fingering on the keyboard, and supplies them to a tone generator. The tone generator produces an audio signal from the music data codes, and a sound system converts the audio signal to the electronic tones. Thus, the trainee checks the fingering for his training through the electronic tones.

A suitable extension may be synchronously moved together with the desk board or shaft. In this instance, the detectors 23A/23B monitor the extension so as to produce the detecting signals.

What is claimed is:

1. A music rack used for keeping a document thereon comprising:

a desk board on which said document is put and changed from a rest position through a maximum attitude angle position to a release position, and an attitude changing system provided between a stationary member and said desk board, permitting said desk board to unidirectionally change the position in a stepless manner from said rest position to said maximum attitude angle position and allowing said desk board to return to said rest position when said desk board reaches the release position.

2. The music rack as set forth in claim 1, in which said attitude changing system includes a shaft connected at one end thereof to said desk board, and a mechanic box secured to said stationary member and having a mechanism connected to the other end of said shaft, enabled in a first angular range between said rest position and said release position so as to permit said shaft to rotate only in a first direction and disabled at said release position so as to permit said shaft to rotate in a second direction opposite to said first direction until said shaft reaches said rest position.

3. The music rack as set forth in claim 2, in which said attitude changing system further includes at least one hinge connected at one end thereof to said stationary member and at the other end thereof to said desk board so as to permit said desk board to rotate in said first direction and said second direction.

4. The music rack as set forth in claim 2, in which said mechanism gives a resistance against the rotation in the second direction.

5. The music rack as set forth in claim 1, in which said attitude changing system includes plural shafts having first end portions connected to said desk board, and plural mechanic boxes secured to said stationary member and having respective mechanisms connected to second end portions of said plural shafts, enabled in a first angular range between said rest position and said release position so as to permit said shaft to rotate only in a first direction and disabled at said release position so as to permit said shaft to rotate in a second direction opposite to said first direction until said desk board reaches said rest position.

6. The music rack as set forth in claim 5, in which said attitude changing system further includes a first detector for producing a first detecting signal when said desk board reaches said release position, a second detector for producing a second detecting signal when said desk board reaches said rest position, and a controller responsive to said first detecting signal so as to disable said mechanism with a driving signal of an inactive level and to said second detecting signal so as to enable said mechanism with said driving signal of an active level.

7. The music rack as set forth in claim 5, in which said mechanism gives a resistance against the rotation in the second direction.

8. A musical instrument comprising a case having plural boards assembled for defining an inner space, a keyboard placed on one of said plural boards in such a manner that a player fingers thereon, a tone generating system accommodated in said inner space and connected to said keyboard for generating tones in response to the fingering, and a music rack provided on another of said plural boards and including a desk board on which said document is put and changed from a rest position through a maximum attitude angle position to a release position and an attitude changing system provided between a stationary member and said desk board, permitting said desk board to unidirectionally change the position from said rest position to said maximum attitude angle position and allowing said desk board to return to said rest position when said desk board reaches the release position.

9. The musical instrument as set forth in claim 8, in which said attitude changing system includes a shaft connected at one end thereof to said desk board, and a mechanic box secured to said stationary member and having a mechanism connected to the other end of said shaft, enabled in a first angular range between said rest position and said release position so as to permit said shaft to rotate only in a first direction and disabled at said release position so as to permit said shaft to rotate in a second direction opposite to said first direction until said shaft reaches said rest position.

10. The musical instrument as set forth in claim 9, in which said attitude changing system further includes at least one hinge connected at one end thereof to said stationary board and at the other end thereof to said desk board so as to permit said desk board to rotate in said first direction and said second direction.

11. The musical instrument as set forth in claim 9, in which said mechanism gives a resistance against the rotation in the second direction.

12. The musical instrument as set forth in claim 8, in which said attitude changing system includes plural shafts having first end portions connected to said desk board, and plural mechanic boxes secured to said stationary member and having respective mechanisms connected to second end portions of said plural shafts, enabled in a first angular range between said rest position and said release position so as to permit said shaft to rotate only in a first direction and disabled at said release position so as to permit said shaft to rotate in a second direction opposite to said first direction until said shaft reaches said rest position.

13. The musical instrument as set forth in claim 12. in which said attitude changing system further includes a first detector for producing a first detecting signal when said desk board reaches said release position, a second detector for producing a second detecting signal when said desk board reaches said rest position, and a controller responsive to said first detecting signal so as to disable said mechanism with a driving signal of an inactive level and to said second detecting signal so as to enable said mechanism with said driving signal of an active level.

14. The musical instrument as set forth in claim 12, in which said mechanism gives a resistance against the rotation in the second direction.

15. The musical instrument as set forth in claim 8, in which said tone generating system includes plural action units actuated by the keys of said keyboard, respectively, plural hammers respectively driven for rotation by said plural action units when said keys actuate the associated action units, and plural strings struck by said plural hammers for generating tones.

16. A music rack used for keeping a document thereon comprising:

a desk board on which said document is put and changed from a rest position through a maximum attitude angle position to a release position, and an attitude changing system provided between a stationary member and said desk board, permitting said desk board to change the position in a stepless manner from said rest position to said maximum attitude angle position when a force is exerted on said desk board and keeping said desk board at any position between said rest position and said maximum attitude angle position when said force is removed from said desk board.

17. A music rack used for keeping a document thereon comprising:

a desk board to place the document, and a system for adjusting an angular position of the desk board, said system provided between a stationary member and said desk board and comprising a clutch to permit said desk board to change the angular position in a stepless manner.

* * * * *